US007506657B2

(12) United States Patent
Hsiao

(10) Patent No.: US 7,506,657 B2
(45) Date of Patent: Mar. 24, 2009

(54) WALKER FOR CHILDREN AND ADULTS

(76) Inventor: Fang-Jung Hsiao, No.55-42, Zhongzbeng Rd., Xinying City, Tainan County 730 (TW)

( * ) Notice: Subject to any disclaimer, the term of this patent is extended or adjusted under 35 U.S.C. 154(b) by 19 days.

(21) Appl. No.: 11/620,165

(22) Filed: Jan. 5, 2007

(65) Prior Publication Data

US 2008/0163913 A1 Jul. 10, 2008

(51) Int. Cl.
*A61H 3/00* (2006.01)

(52) U.S. Cl. ..... 135/67; 135/74; 135/75; 482/68; 403/107

(58) Field of Classification Search ..... 135/65–67, 135/74–75; 482/66–68; 280/304.1, 87.021; 248/407–409; 403/107–108, 322.4
See application file for complete search history.

(56) References Cited

U.S. PATENT DOCUMENTS 2,996,070 A * 8/1961 Ries ..... 135/67
3,098,651 A * 7/1963 Murcott ..... 482/66
3,658,079 A * 4/1972 Block ..... 135/67
4,298,016 A * 11/1981 Garelick ..... 135/67
4,476,885 A * 10/1984 Stein ..... 135/69
4,531,731 A * 7/1985 Law ..... 482/144
4,619,282 A * 10/1986 Battiston ..... 135/67
4,640,301 A * 2/1987 Battiston et al. ..... 135/67
4,830,035 A * 5/1989 Liu ..... 135/67
4,995,412 A * 2/1991 Hirn et al. ..... 135/67
5,020,560 A * 6/1991 Turbeville ..... 135/67
5,058,912 A * 10/1991 Harroun ..... 280/87.021
5,158,313 A * 10/1992 Becker ..... 280/87.021
5,353,824 A * 10/1994 Woods et al. ..... 135/66
5,433,235 A * 7/1995 Miric et al. ..... 135/67
5,529,425 A * 6/1996 Spies et al. ..... 403/322.4
5,692,762 A * 12/1997 Obitts ..... 280/87.05
6,886,575 B2 * 5/2005 Diamond ..... 135/74
7,040,637 B2 * 5/2006 Owens et al. ..... 280/87.021

* cited by examiner

*Primary Examiner*—Winnie Yip
(74) *Attorney, Agent, or Firm*—Alan Kamrath; Kamrath & Associates PA

(57) ABSTRACT

A walker for both child and adult users includes two supporting units and a connecting unit transversely connecting the two supporting units at the front sides thereof. A horizontal rod is provided between two leg portions of each said supporting unit. Each said horizontal rod has two slots at the opposite ends. Two sliding joints are mounted on the supporting units in the manner that the ends of the horizontal rod can be received by the sliding joints, and two pin members can be respectively pierced through one of the sliding joints and the corresponding slot. Further, two sets of clutch members each having a toothed portion for being detachably engaged with each other are provided between the ends of the telescopic members of the connecting unit and the adjacent supporting units. Thus, the horizontal rods can freely shift vertically corresponding to the variation of the height of the walker, and through operating the clutch members of the positioning units to become engaged or disengaged mutually, the opposite supporting units can be easily and stably fixed after being unfolded, or alternatively, can be operated in a reciprocal manner.

8 Claims, 13 Drawing Sheets

WALKER FOR CHILDREN AND ADULTS

CROSS-REFERENCES TO RELATED APPLICATIONS

Not Applicable

STATEMENT REGARDING FEDERALLY SPONSORED RESEARCH OR DEVELOPMENT

Not Applicable

DESCRIPTION

1. Technical Field

The present invention relates to walkers for both children and adults and, more particularly, to a walker that is characterized by improved foldability and structural stability. Further, the disclosed walker can be used in both reciprocal and immobile ways.

2. Description of Related Art

Walkers are generally provided for leg-handicapped people as auxiliary equipment to facilitate stable walking. A conventional walker, as shown in FIGS. 1 and 2, primarily comprises two supporting legs 11 each having a reversed-U shape, a connecting bar 12 for connecting the two supporting legs 11 at the front sides thereof, a pair of horizontal rods 13 respectively provided for each supporting leg 11 by being settled between two leg portions 111 thereof, and two pairs of adjusting tubes 112 attached respectively to each said leg portion 111. Though the supporting legs 11 of such conventional walker are height-adjustable in some measure, diverse manufacturing sizes of walkers are nevertheless required for adult and child users (as shown in FIGS. 3 and 4). However, the abovementioned diverse manufacturing sizes can consume significant cost and effort in manufacturing, material preparation and product stocking. Thus, to make a walker that fits both children and adults, some development has been done to broaden the adjustment allowance of the walker by raising the position of the horizontal rods 13 with respect to the supporting legs 11 (as shown in FIG. 5) and lengthening the adjusting tubes 112. However, when the adjusting tubes 112 are extended to an extreme position, the horizontal rods 13 are consequently unduly raised and the structural strength of the walker is substantially deteriorated. Thus, the strategy is defective and impracticable.

Furthermore, walkers may be manufactured to be foldable to facilitate storage and transport. For instance, one exemplificative single-button walker, as shown in FIG. 6, comprises two opposite supporting legs 11, a connecting bar 12 of which both ends are mounted onto sleeves 121 rotatably receiving the supporting legs 11, two horizontal rods 13 each being fixedly fastened to said supporting leg 11 between two leg portions 111 thereof, and two telescopic members 141, 142 settled between the two supporting legs 11 at the upper portions thereof. Each of the telescopic members 141, 142 is pivotally connected to the adjacent supporting leg 11 with the outer end thereof, and a positioning unit 143 is provided between the telescopic members 141, 142 for the purpose that when the positioning unit 143 is operated, the telescopic members 141, 142 can be telescoped and the supporting legs 11 connected to the ends thereof can be folded or spread. Nevertheless, as the horizontal rods 13 on such single-button walker are also fixedly arranged, the walker is not capable of fitting both child and adult users, and the need for manufacturing diverse sized walkers still exists. Besides, when the supporting legs 11 are relatively spread or unfolded, the integral length of the telescoped telescopic members 141, 142 has to be just enough to make a retaining member 110 press close to one end of a slot 122 so that the supporting legs 11 can be stably fixed. Inasmuch as such accurate assembly is difficult to achieve in practice, such conventional walkers are therefore often slightly loose and sway during use.

SUMMARY OF THE INVENTION

To overcome the defects of the foregoing conventional walkers, such as not being adaptable for both child and adult users as well as having unchangeable function, the walker of the present invention comprises a connecting unit provided between two supporting units at the front sides thereof, a horizontal rod which has two slots at both ends and is settled between two sliding joints which are mounted onto the two supporting units at the front legs thereof, and a pair of pin members inserted into the slots through the sliding joints.

Further, the connecting unit of the present invention comprises a set of telescopic members that are mutually assembled and can be relatively shifted and fixed. Between each of the telescopic members and the adjacent supporting unit, one positioning unit including two clutch members is provided. The clutch members have respectively a toothed segment that can be engaged with or disengaged from the other toothed segment.

Thus, by the foresaid technical solution, the horizontal rods can freely shift vertically along the supporting units corresponding to the variation of the height of the walker so that when the walker is adjusted to a desirable height, the horizontal rods can remain at the most moderate position with respect to the supporting units so that the structural strength and stability of the walker can be maintained at the optimum conditions.

Also, the clutch members of the positioning unit help not only by allowing the walker to be folded but also by ensuring that the supporting units are stably fixed without looseness or sway after being unfolded. Furthermore, the clutch members also permit the supporting units to be operated in a reciprocal manner, and, therefore, the disclosed walker provides multiple functions to a user.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENT

Figure 1:
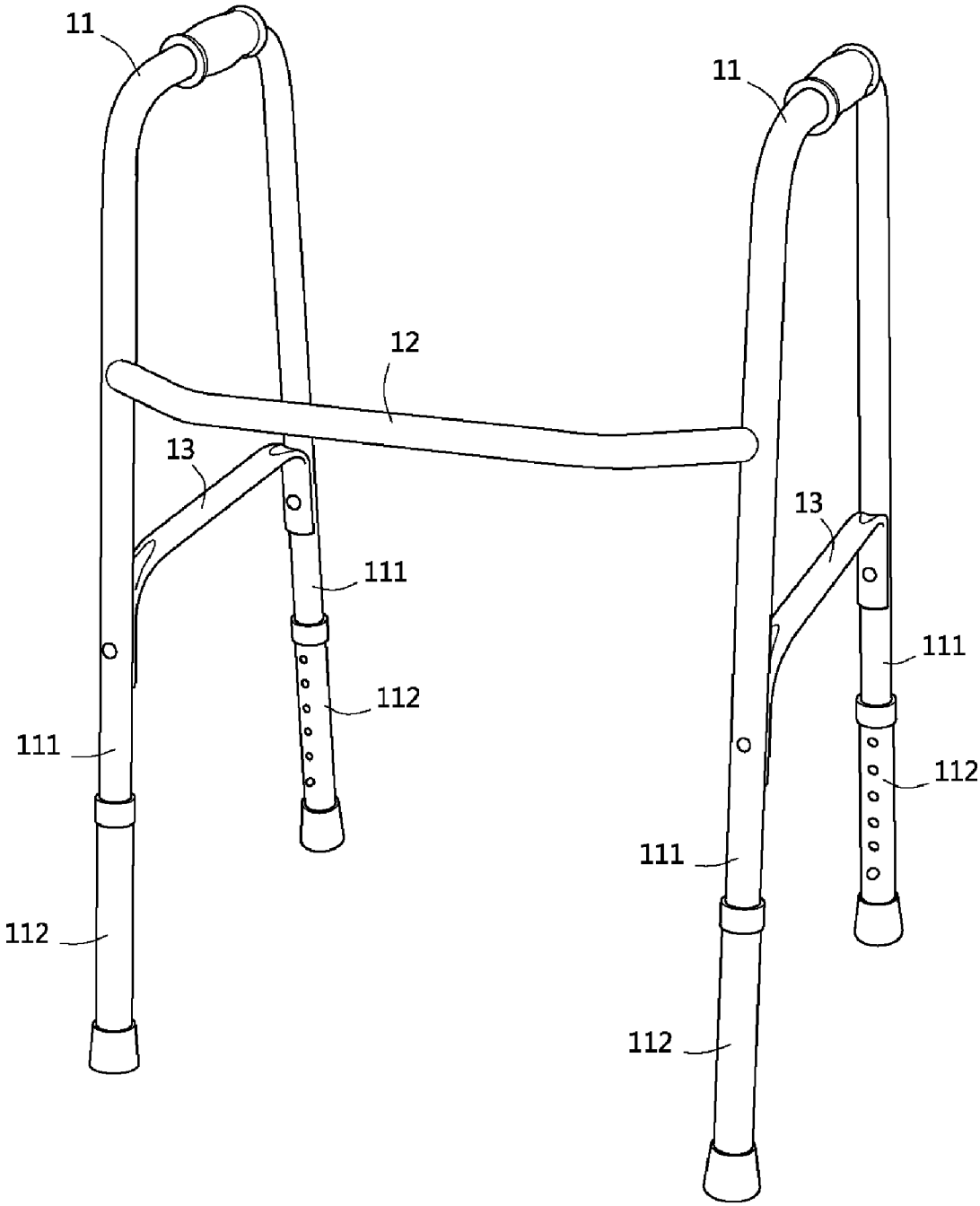
FIG.1(Prior Art)
FIG. 1 is a perspective view of a conventional walker.
Figure 2:
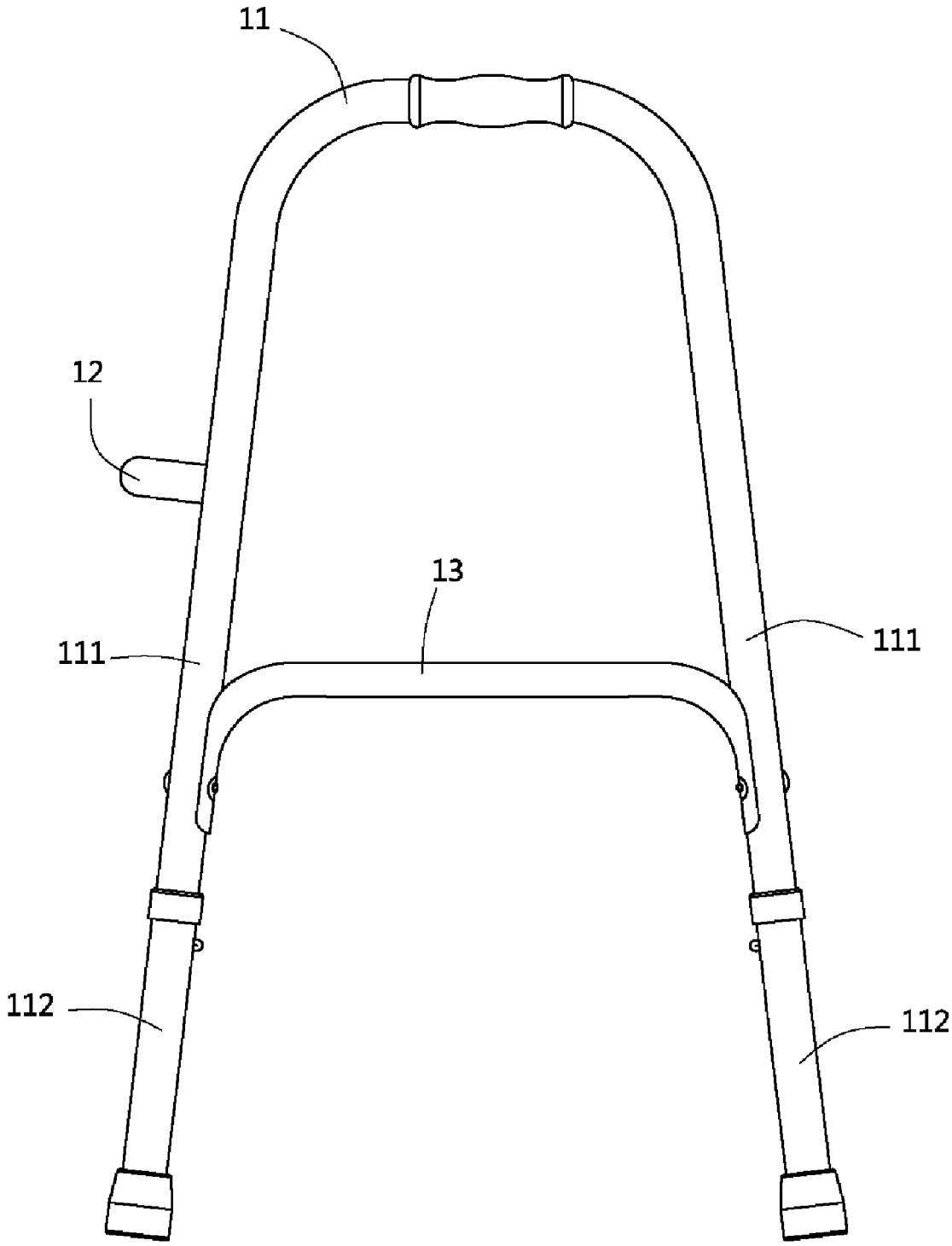
FIG.2(Prior Art)
FIG. 2 is a lateral view of the conventional walker.
Figure 3:
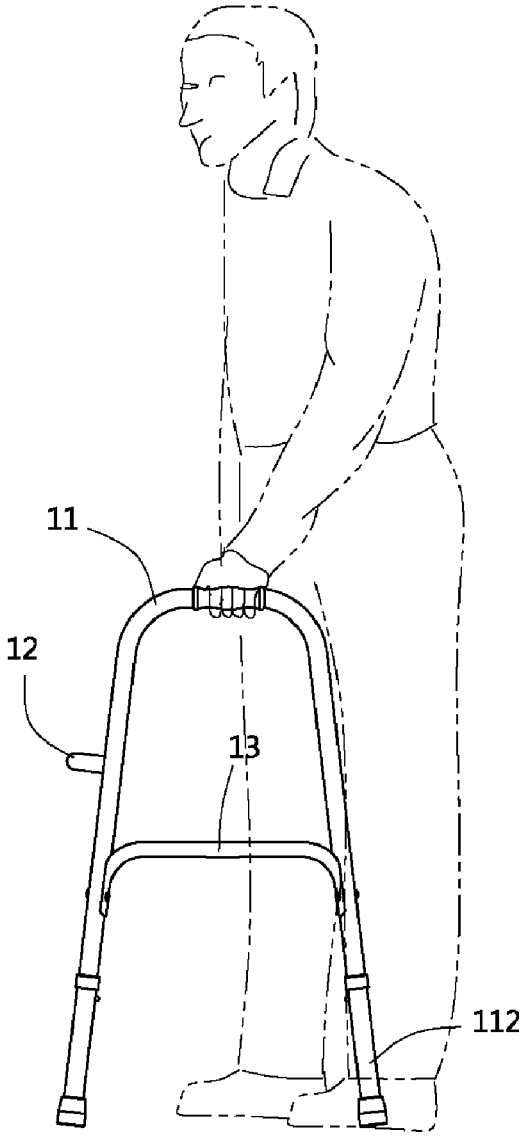
FIG.3(Prior Art)
FIG. 3 is a schematic drawing of a conventional walker for adults.
Figure 4:
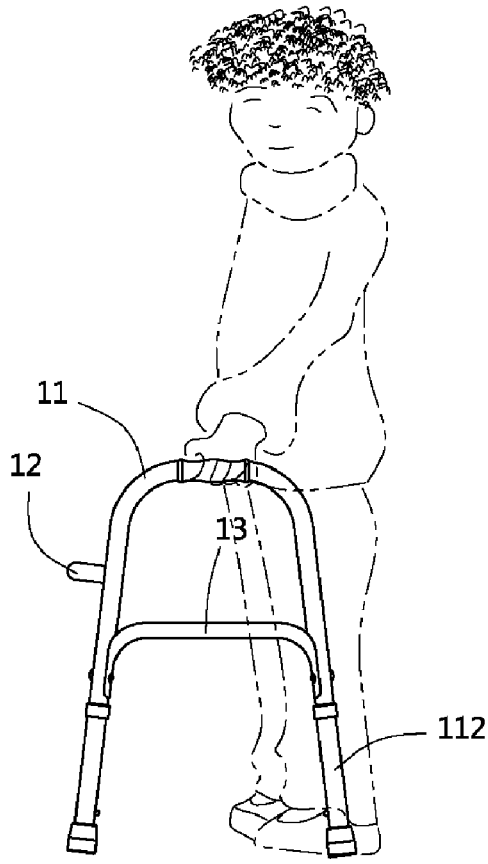
FIG.4(Prior Art)
FIG. 4 is a schematic drawing of a conventional walker for children.
Figure 5:
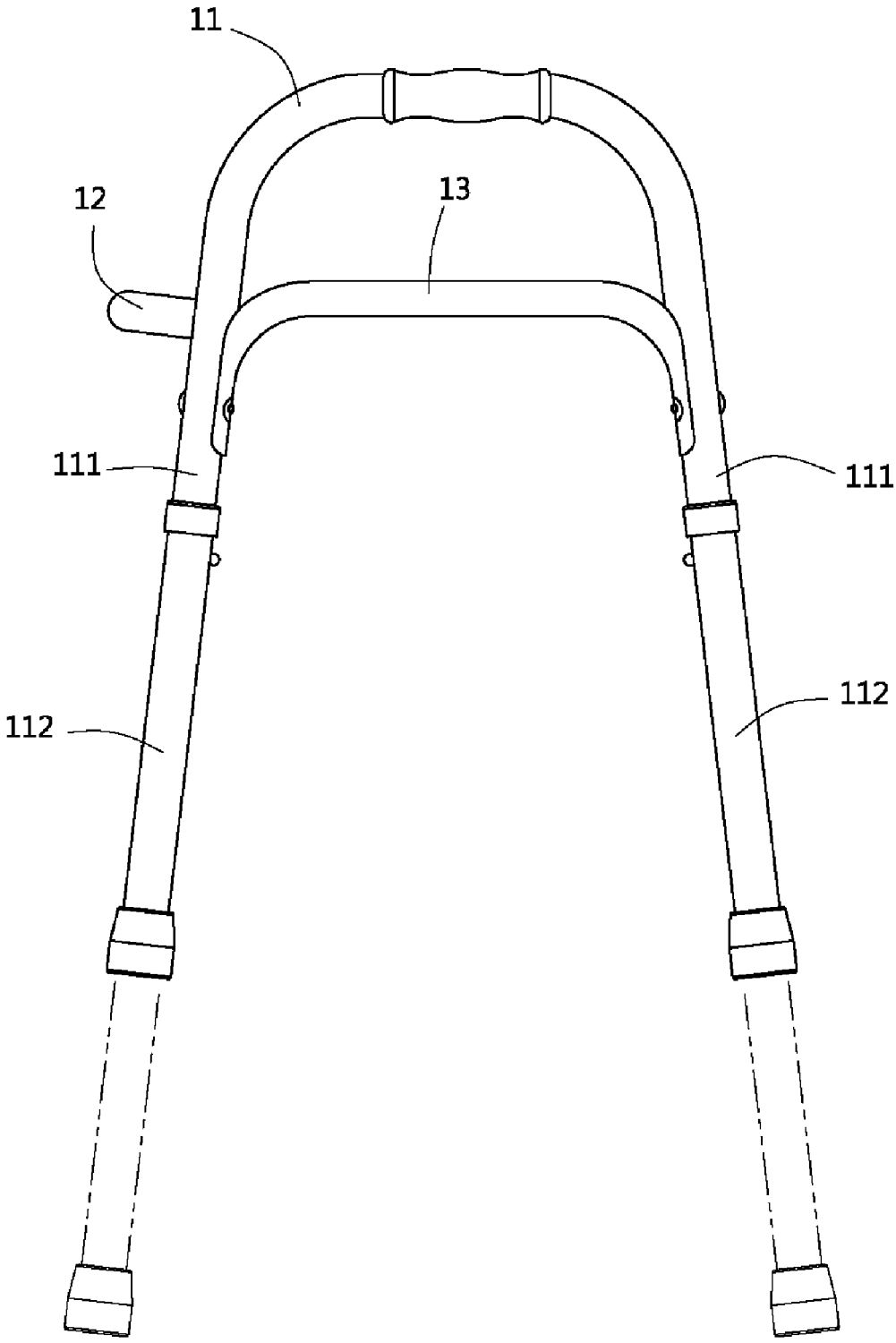
FIG.5(Prior Art)
FIG. 5 is a schematic drawing of another conventional walker for both children and adults.
Figure 6:
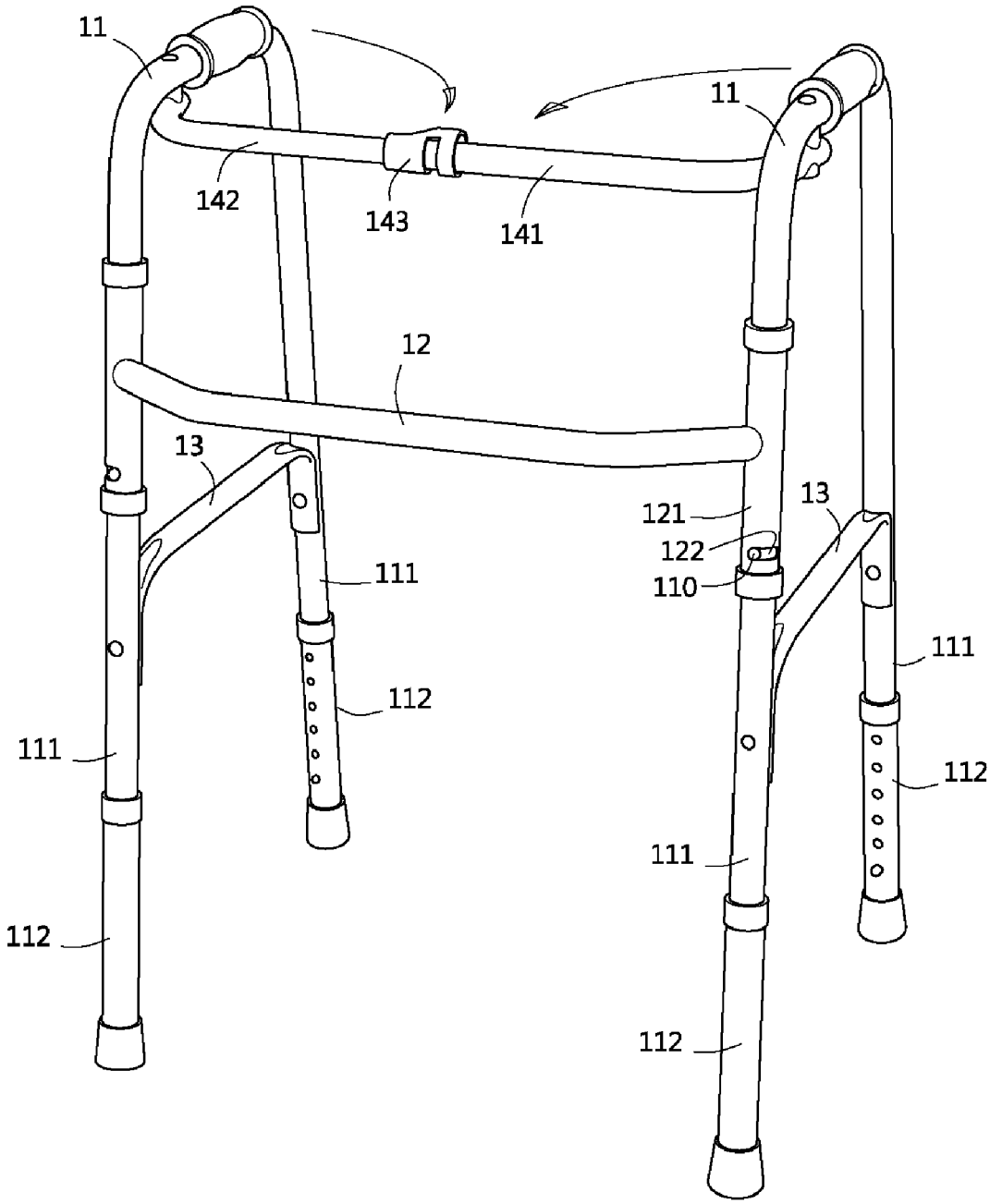
FIG.6(Prior Art)
FIG. 6 is a schematic drawing of a conventional foldable walker.
Figure 7:
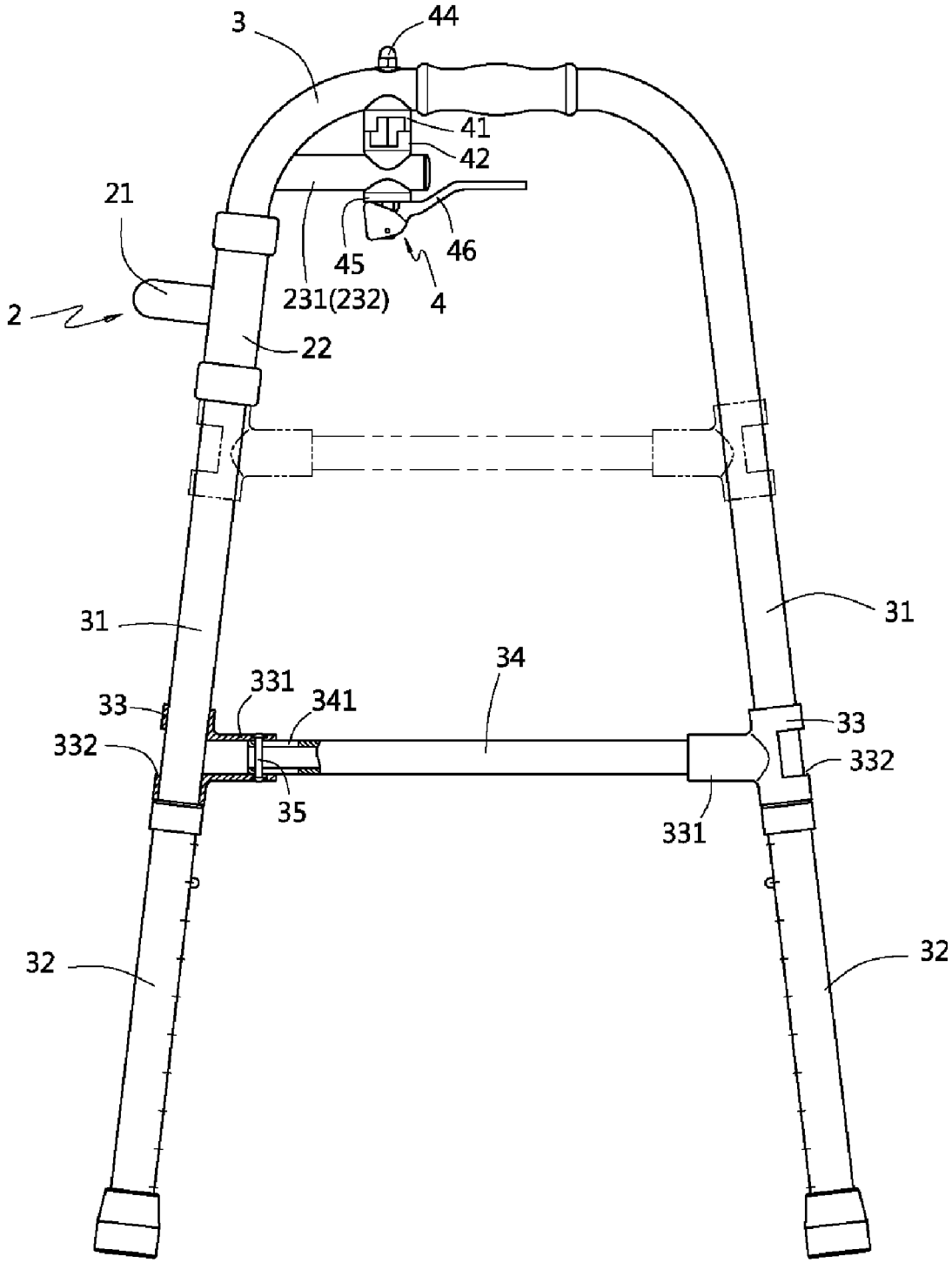
FIG. 7 is a lateral view of a walker according to the present invention.

Referring to FIG. 7, the walker of the present invention primarily comprises two supporting units 3 settled oppositely and a connecting unit 2 transversely connecting the two supporting units 3 at the front sides thereof, which will be explained in more detail below.

Figure 8:
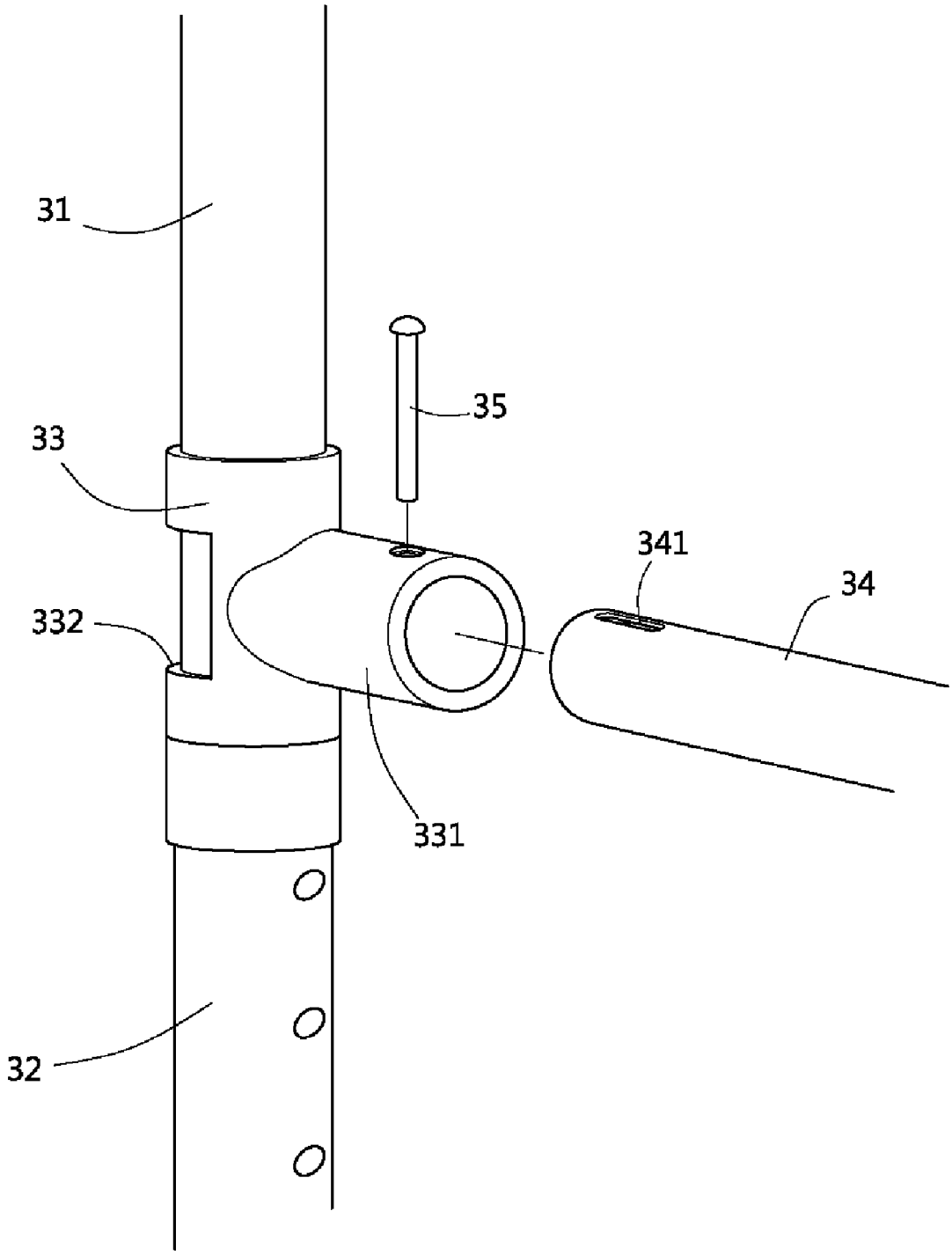
FIG. 8 is a partial exploded view of the disclosed walker showing the assembly of the supporting unit and horizontal rod.

As shown in FIG. 8, each of the two opposite supporting units 3 has two leg portions 31 at both sides. Further, each of the leg portions 31 has an adjusting tube 32 attached at the bottom thereof in the manner that the adjusting tube 32 can be freely expanded, contracted and fixed with respect to the leg portion 31. Moreover, two opposite sliding joints 33 are provided to surround the two leg portions 31 respectively in a freely slidable way. Each of the sliding joints 33 comprises a receiving portion 331 at the inner side opposite to the other sliding joint 33. A horizontal rod 34, which has two slots 341 positioned respectively at both ends, is provided between the two sliding joints 33 in the manner that both ends of the horizontal rod 34 are received by the adjacent receiving portions 331 of the sliding joints 33. Further, two pin members 35 are respectively pierced through the receiving portions 331 and the corresponding slots 341 of the horizontal rod 34 so that the horizontal rod 34 can axially shift with respect to the receiving portions 331. Additionally, each of the sliding joints 33 further comprises an opening 332, and the leg portion 31 has printed signs on the surface corresponding to the opening 332 so that a user can be informed of the relative position thereby.

Figure 9:
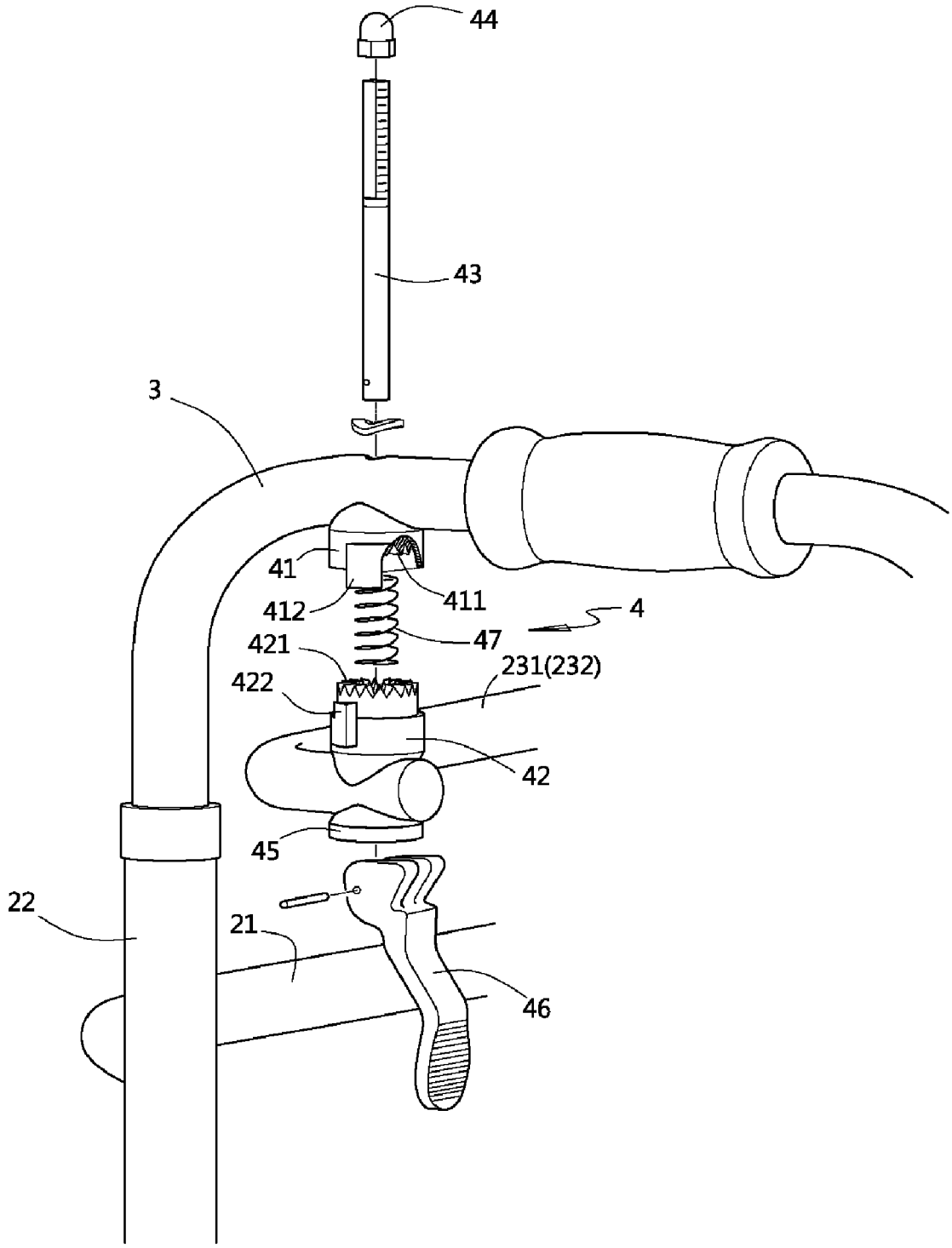
FIG. 9 is an exploded view of the positioning unit according to the present invention.
Figure 15:
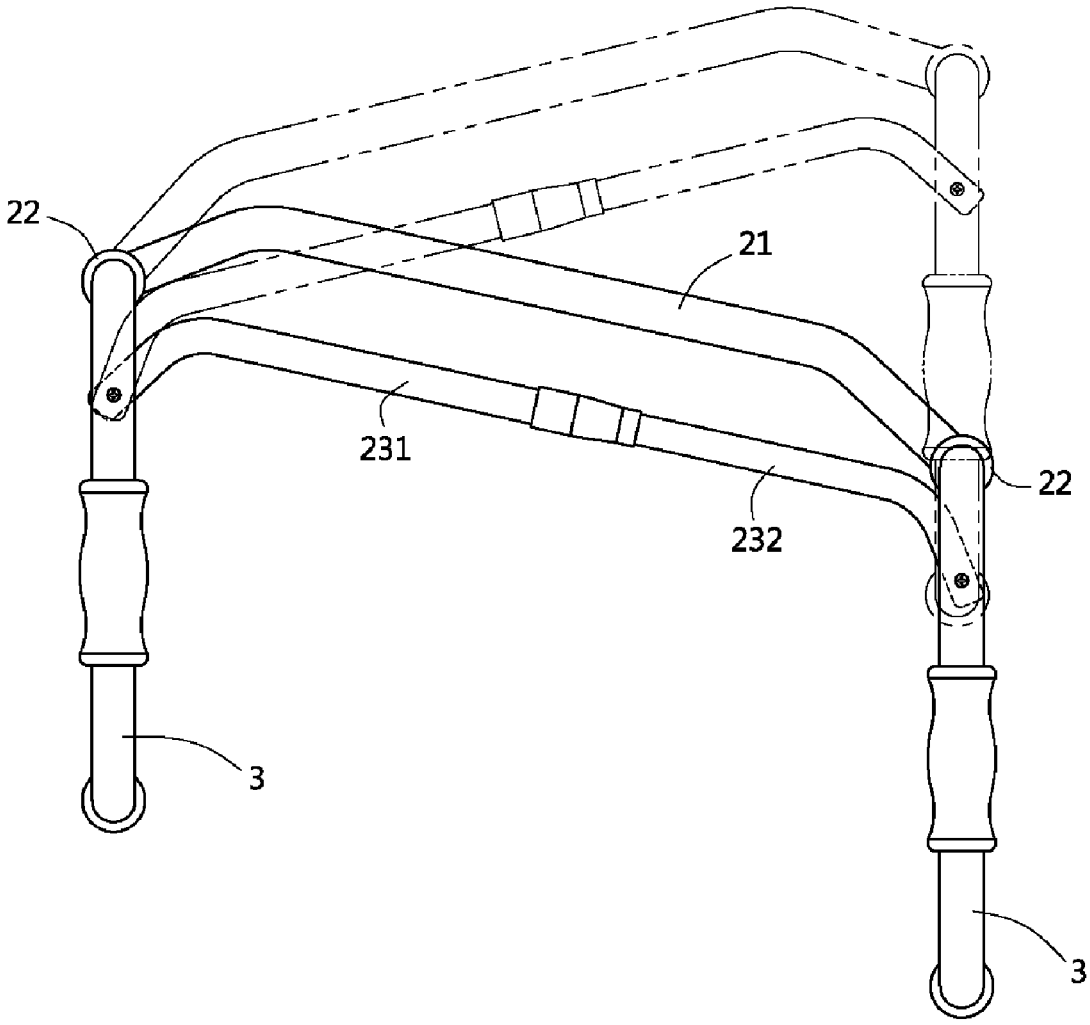
FIG. 15 is a top view showing the walker operated in a reciprocal manner.

As to the connecting unit 2, according to FIG. 9, it comprises a connecting bar 21 which is mounted onto the opposite supporting units 3 at the front leg portions 31 with two sleeves 22 arranged at both ends thereof, and two telescopic members 231, 232 (as shown in FIG. 15) which are provided above the connecting bar 21 and can be telescoped and fixed mutually. Further, between each of the telescopic members 231, 232 and the corresponding supporting unit 3, a positioning unit 4 is provided which comprises a set of clutch members 41, 42 that can be coupled mutually with the respective mated toothed segment 411 or 421 arranged oppositely. Each of the upper clutch members 41 has the upper end thereof inlayed onto the corresponding supporting unit 3, and is fastened to the supporting unit 3 by a shaft 43 and a cap nut 44. Furthermore, the shaft 43 has the opposite end pierced through and binding the lower clutch member 42, the telescopic member 231 (232), a socket 45 inlayed at the bottom of the telescopic member 231 (232) and a switch 46 together. The switch 46 is fastened at an eccentricity thereof. Additionally, an elastic member 47 can be provided between the upper and lower clutch members 41, 42 to push them apart so that the distance between the joint of the switch 46 and the shaft 43 and the socket 45 can be changed by turning the switch 46, and the toothed segments 411, 421 of the clutch members 41, 42 can be in turn engaged with or disengaged from each other. In addition, two retaining segments 412, 422 are respectively provided at the outer surface of the clutch members 41, 42 in the manner that the supporting units 3 can be unfolded until the retaining segments 412, 422 come to be retained mutually.

Figure 10:
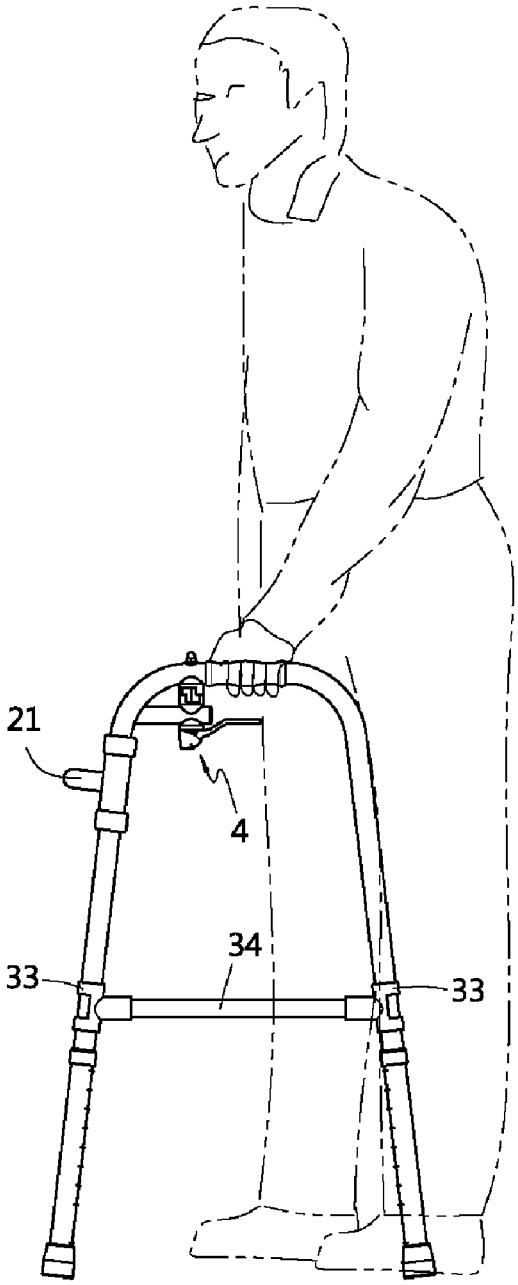
FIG. 10 is an applied view showing the disclosed walker adapted to an adult.
Figure 11:
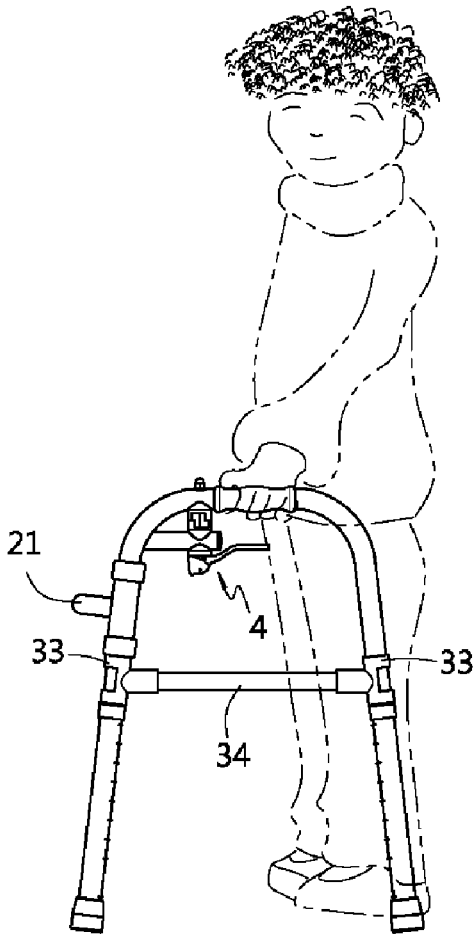
FIG. 11 is an applied view showing the disclosed walker adapted to a child.

Thereby, as shown in FIGS. 7, 10, and 11, when each of the horizontal rods 34 of the supporting unit 3 is lifted, the corresponding adjusting tubes 32 can be drawn inward and fixed so that the integral height of the disclosed walker can be consequently reduced to fit a child. When the adjusting tubes 32 are extended outward and fixed, the horizontal rod 34 can therefore be pulled down so that the integral height of the disclosed walker can be fit for an adult user. Thus, in addition to the feature that the significantly adjustable height of the present invention for accommodating children and adults, as the horizontal rods 34 can be vertically shifted in response to the variation of the height of the walker, the horizontal rods 34 can always be situated at the most moderate position with respect to the supporting unit 3 so that the optimal structural strength of the walker can be kept. As a result, the walker of the present invention can stand more stably, and ensures against looseness and sway.

Also, when adjusting the walker, a user can observe the variation of the signs appearing through the openings 332 of the sliding joints 33 mounted on the leg portions 31 and can realize the adjusted height of the walker is appropriate for a user of what height.

Figure 12:
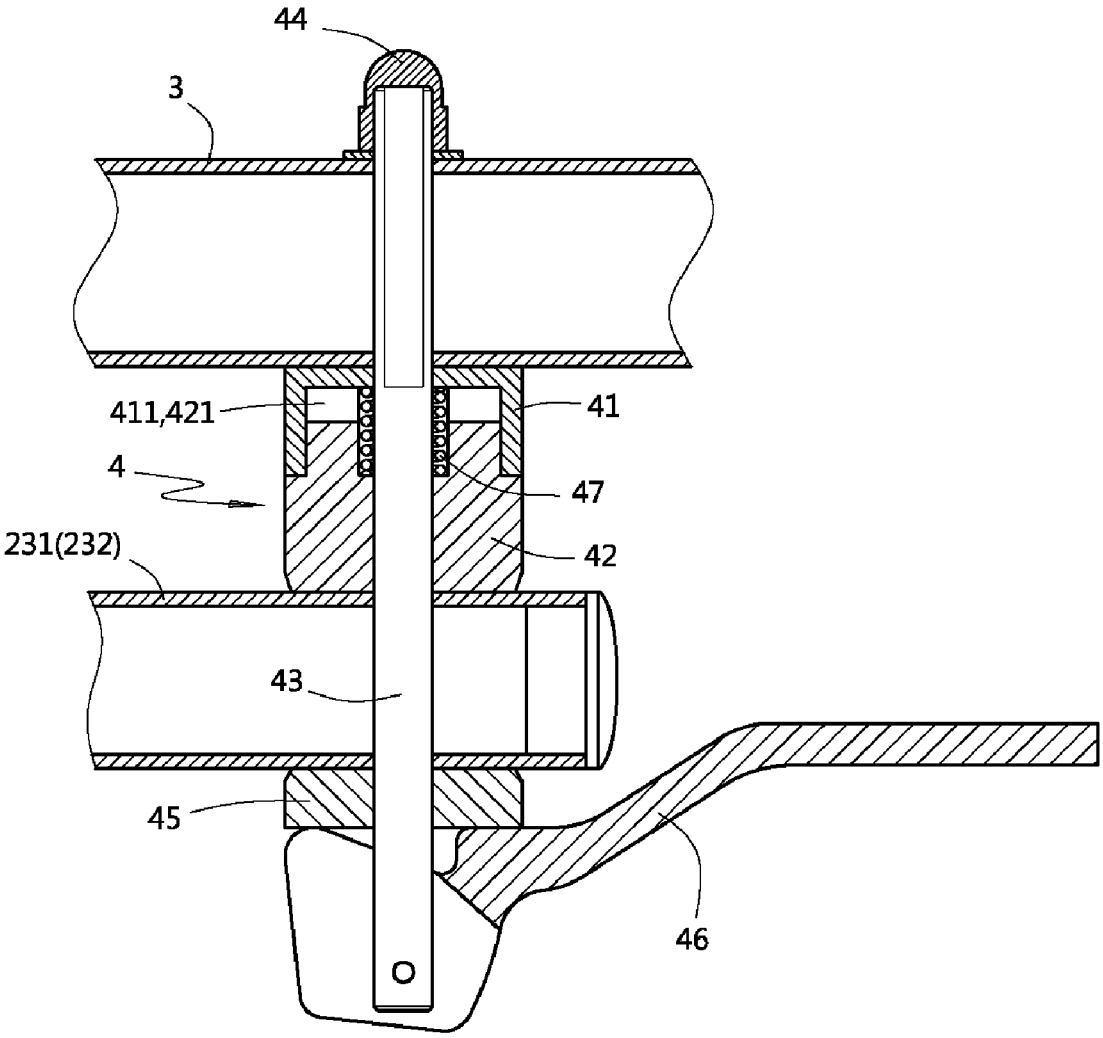
FIG. 12 is a cross sectional transverse view showing the positioning unit of the present invention when fastened.
Figure 13:
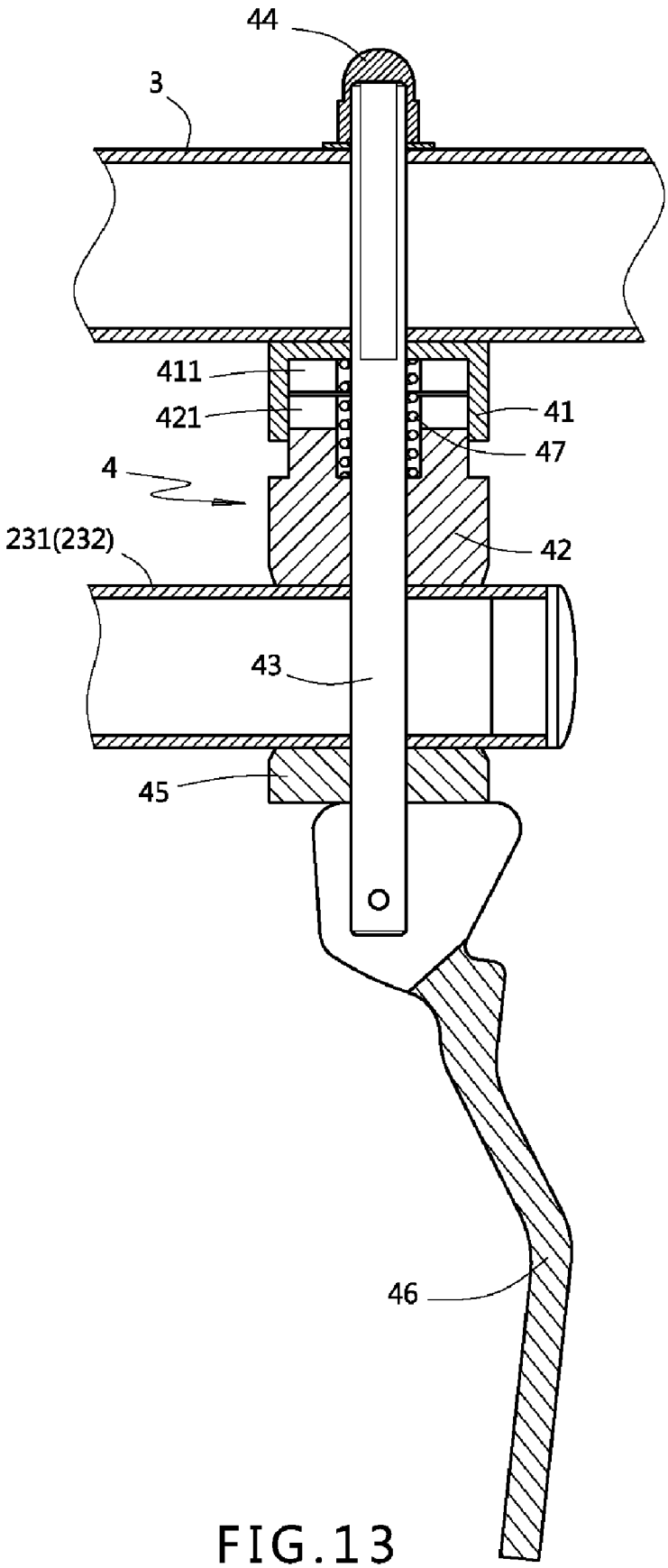
FIG. 13 is a cross sectional transverse view showing the positioning unit of the present invention when released.

Furthermore, as shown in FIG. 13, when the switch 46 of the positioning unit 4 according to the present invention is turned downward and causes the clutch members 41, 42 to be separated, the two opposite supporting units 3 can be folded inward. Further, as shown in FIG. 12, as the opposite supporting units 3 are fully unfolded, the switch 46 can be turned upward to make the clutch members 41, 42 become engaged mutually so that the telescopic members 231, 232 can be restrained from pivoting with respect to the opposite supporting units 3. Therefore, the disclosed walker can be assembled more perfectly and firmly. Thus, the present invention provides an auxiliary for a handicapped user with preferable stability and security.

Figure 14:
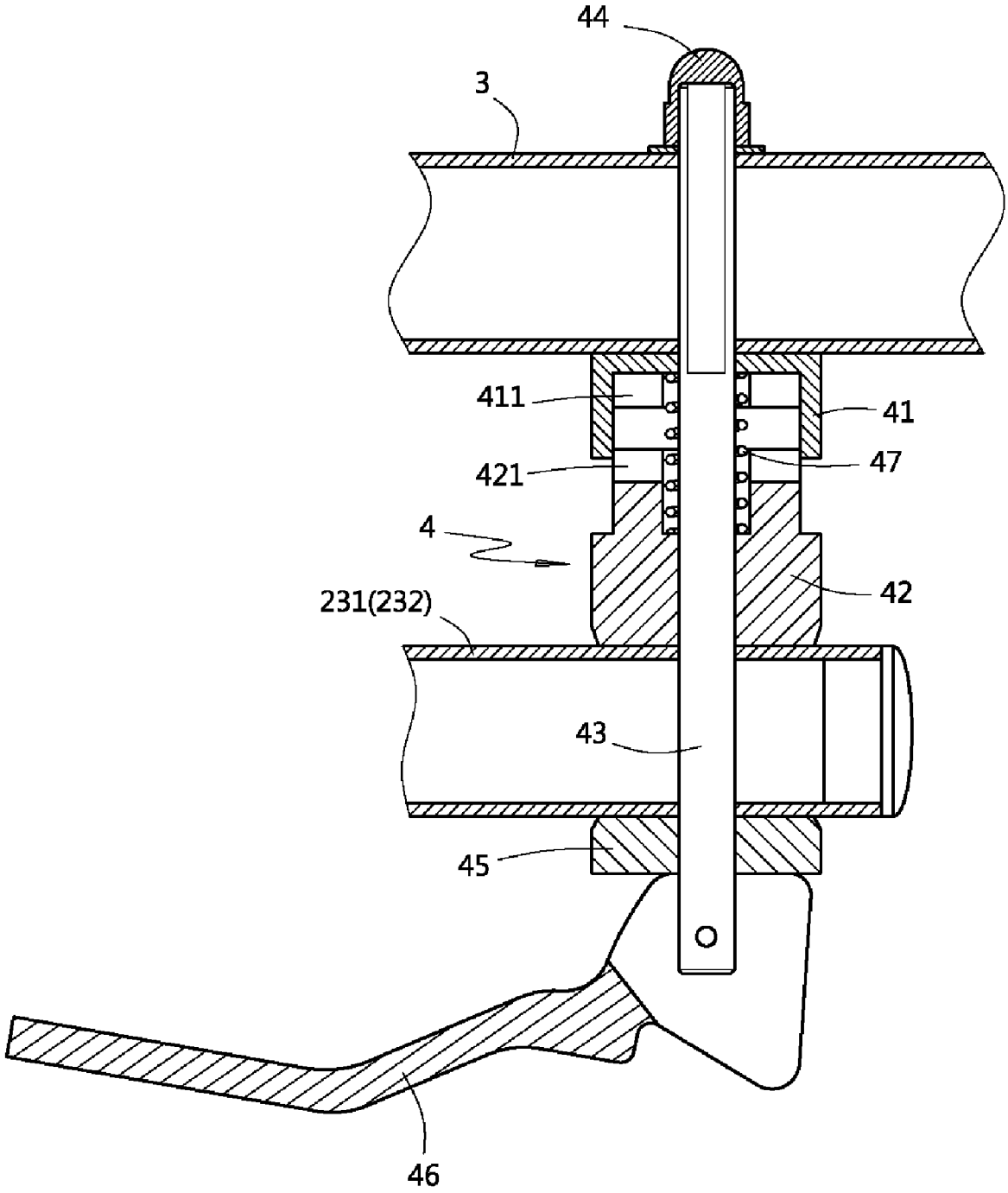
FIG. 14 is a cross sectional transverse view showing the positioning unit of the present invention when completely released.

Furthermore, referring to FIG. 14, when the supporting units 3 are unfolded and fixed, the switch 46 of the positioning unit 4 can be further turned toward the reverse side so that not only the clutch members 41, 42 become separated, but the retaining segments 412, 422 of the clutch members 41, 42 as shown in FIG. 7, also become staggered and spaced from each other. At this point, the supporting units 3 can be moved in a reciprocal manner (as depicted in FIG. 15), and the disclosed walker can therefore provide multiple functions to a user.

Although a particular embodiment of the invention has been described in detail for purposes of illustration, it will be understood by one of ordinary skill in the art that numerous variations will be possible to the disclosed embodiments without going outside the scope of the invention as disclosed in the claims.

What is claimed is:

1. A walker for children and adults comprising:

two supporting units, each having two leg portions at front and back sides wherein each of the two leg portions are respectively attached by an adjusting tube that can be vertically adjusted and fixed with respect to the leg portion, and wherein a horizontal rod is provided between the two leg portions; and a connecting unit transversely connecting the two supporting units at the front sides thereof;

wherein each said horizontal rod has two slots at opposite ends and two sliding joints are mounted on the supporting units in the manner that the ends of the horizontal rod can be received by the sliding joints, wherein two pin members respectively pierce through one of the sliding joints and the corresponding slot wherein the two pin members slide horizontally in the two slots, and wherein when the horizontal rod is shifted vertically, the sliding joints freely slide along the corresponding leg portions.

2. The walker of claim 1, wherein at least one of the sliding joints mounted on the supporting unit has an opening settled at the surface thereof.

3. A walker for children and adults comprising:

two supporting units, each having two leg portions at front and back sides wherein each of the two leg portions are respectively attached by an adjusting tube that can be vertically adjusted and fixed with respect to the leg portion, and wherein a horizontal rod is provided between the two leg portions; and a connecting unit transversely connecting the two supporting units at the front sides thereof which comprises a connecting bar having the two ends thereof pivotally mounted on the front sides of the supporting units to function as pivot shafts that permit the supporting units to be folded inward; and a set of telescopic members being relatively telescoped and fixed together, and having ends being respectively connected to the adjacent supporting unit by a positioning unit, wherein each said positioning unit has a set of upper and lower clutch members each having a toothed portion for being detachably engaged with the toothed portion of the other clutch member, an elastic member being provided between the upper and lower clutch members to push them apart and a shaft having its upper end assembled to the corresponding supporting unit while its lower end being pierced through the two clutch members and the corresponding telescopic member to pivotally fasten a switch at an eccentricity thereof so that the clutch members can be operated to become mutually engaged and disengaged by turning the switch; and whereby the opposite supporting unit can be folded when the clutch members of the positioning units are disengaged.

4. The walker of claim 3, wherein two retaining segments are respectively protruded from the clutch members for the purpose that the supporting units can be unfolded and accurately fixed at a predetermined position.

5. A walker for children and adults comprising:

two supporting units, each having two leg portions at front and back sides wherein each of the two leg portions are respectively attached by an adjusting tube that can be vertically adjusted and fixed with respect to the leg portion, and wherein a horizontal rod is provided between the two leg portions; and a connecting unit transversely connecting the two supporting units at the front sides thereof which comprises a connecting bar having the two ends thereof pivotally mounted on the front sides of the supporting units to function as pivot shafts that permit the supporting units to be folded inward; and a set of telescopic members being relatively telescoped and fixed together and having ends being respectively connected to the adjacent supporting unit by a positioning unit, wherein each said horizontal rod has two slots at the opposite ends and two sliding joints are mounted on the supporting units in the manner that the ends of the horizontal rod are received by the sliding joints and two pin members are respectively pierced through one of the sliding joints and the corresponding slot so that when the horizontal rod is shifted vertically, the sliding joints can freely slide along the corresponding leg portions;

wherein each said positioning unit has a set of upper and lower clutch members each having a toothed portion for being detachably engaged with the toothed portion of the other clutch member.

6. The walker of claim 5, wherein at least one of the sliding joints mounted on the corresponding supporting unit has an opening settled at the surface thereof.

7. The walker of claim 5, wherein an elastic member is provided between the upper and lower clutch members to push them apart and a shaft has its upper end assembled to the corresponding supporting unit while its lower end is pierced through the two clutch members and the corresponding telescopic member to pivotally fasten a switch at an eccentricity thereof so that the clutch members can be operated to become mutually engaged or disengaged by turning the switch.

8. The walker of claim 7, wherein two retaining segments are respectively protruded from the clutch members for the purpose that the supporting units can be unfolded and accurately fixed at a predetermined position.

* * * * *